US007484254B2

(12) United States Patent
Eriksson et al.

(10) Patent No.: US 7,484,254 B2
(45) Date of Patent: Feb. 3, 2009

(54) ARTICULATED BED

(75) Inventors: Rikard Eriksson, Tibro (SE); Mikael Johansson, Tibro (SE)

(73) Assignee: Hilding Anders International AB, Malmo (SE)

( * ) Notice: Subject to any disclaimer, the term of this patent is extended or adjusted under 35 U.S.C. 154(b) by 122 days.

(21) Appl. No.: 10/556,082

(22) PCT Filed: May 14, 2004

(86) PCT No.: PCT/SE2004/000744

§ 371 (c)(1),
(2), (4) Date: Jan. 22, 2007

(87) PCT Pub. No.: WO2004/100723

PCT Pub. Date: Nov. 25, 2004

(65) Prior Publication Data

US 2007/0163046 A1 Jul. 19, 2007

(30) Foreign Application Priority Data

May 16, 2003 (SE) ..... 0301465

(51) Int. Cl.
*A61G 7/015* (2006.01)
*A61G 7/018* (2006.01)

(52) U.S. Cl. ..... 5/618; 5/616

(58) Field of Classification Search ..... 5/618, 5/616, 617, 613, 600
See application file for complete search history.

(56) References Cited

U.S. PATENT DOCUMENTS

| | | | |
|---|---|---|---|
| 4,679,261 | A | 7/1987 | Stanley et al. |
| 5,063,623 | A | 11/1991 | Bathrick et al. |
| 5,544,375 | A | 8/1996 | Urness et al. |
| 6,101,647 | A | 8/2000 | Stroud et al. |

FOREIGN PATENT DOCUMENTS

| | | |
|---|---|---|
| DE | 2 023 104 | 11/1971 |
| FR | 2 726 982 | 11/1994 |
| JP | 2000-152852 | 6/2000 |
| WO | WO 97/30614 | 8/1997 |
| WO | WO 01/93725 A1 | 6/2001 |

OTHER PUBLICATIONS

International Search Reports.

*Primary Examiner*—Alexander Grosz
(74) *Attorney, Agent, or Firm*—Harness, Dickey & Pierce, P.L.C.

(57) ABSTRACT

A bed arrangement (10) has an articulated mattress support (30), a support frame (40) for the articulated mattress support, and a power assembly (50) for raising and lowering flexible sections (30*b*, 30*c*, 30*d*) of the articulated mattress support. The support frame (40) is adjustably mounted in a stationary outer frame (20) and has a size smaller than the articulated mattress support (30). The power assembly (50) is mounted on the support frame (40).

8 Claims, 4 Drawing Sheets

ARTICULATED BED

TECHNICAL FIELD

The present invention relates to a bed arrangement comprising an articulated mattress support, a support frame for the articulated mattress support, and a power assembly for raising and lowering flexible sections of the articulated mattress support.

DESCRIPTION OF PRIOR ART

Beds using adjustable or articulated bed mattresses, frames and/or bedsteads have been known for a long time, in particular beds for hospitals, nursing homes and homes for the elderly.

In recent times, the commercial need of such beds in the residential market has increased, especially for beds that can be automatically adjusted/inclined by means of a motorised framework using electrically driven power module arrangements. These articulated beds often comprise an outer frame and a mattress-supporting inner frame having sections which are foldable or pivotable by means of the motorised framework.

The motorised frameworks according to prior art are constructed in two different ways having basically the same function but different structures. The first type of frame is fixed to a stationary outer frame, so that when inclining the bed to a desired position, e.g. raising the head and/or foot portion, the head end or portion moves away from the short end of the bed or any bedtable or bedstand, thereby making it less accessible for the bed user, and vice versa when lowering the bed. The second type of frame is also connected to the stationary outer frame but in a movable way, so that, when the bed is raised, this second movable framework is displaced in relation to the outer frame and compensates for the increasing distance between the associated bed sections, e.g. the head end of the bed and the outer fixed frame by sliding or rolling in a direction essentially opposite the raising direction, whereby the distance between the raised mattress and the adjacent stationary short end of the bed is kept essentially constant.

U.S. Pat. No. 5,063,623 describes a power module for an articulated bed, the power module being adapted to easily fit into a standard bed frame. The power module has a housing which is exclusively fixed to a stationary middle section of the mattress support, the stationary section being hinged to planar mattress support panels which are swung up and down into desired bed positions by means of rocker arms and shafts driven by the power module.

The power module in U.S. Pat. No. 5,063,623 has a limited applicability for beds because it is not easily dismounted from the mattress support or mounted onto the same under the bed on-site. Furthermore, the possibility of separately removing the mattress support for enabling access to the power module from above is also eliminated. This combined mattress support and power module unit also becomes very heavy and unwieldy, and therefore laborious when assembling/mounting it in the outer fixed frame.

A bed frame arrangement with a framework of the second above-mentioned slidable type is described in WO 01/93725 A1. Here, a movable inner frame is displaced by sliding in relation to a fixed outer frame through the medium of elongate slide blocks sliding inside stationary guide rails. The slide blocks are attached to the inside of the outer frame and the guide rails are attached to the outside of the inner frame or vice versa.

The known bed frame arrangement disclosed in WO 01/93725 A1 has a disadvantage in that the sliding blocks and the guide rails are placed near/close to the outer edge of the bed, which means that the risk of squeezing or crushing hands and/or fingers between the slide blocks and the guide rails is imminent, in particular for children having small hands and fingers.

SUMMARY OF THE INVENTION

The main object of the present invention is to provide a new bed arrangement which is improved over prior art and which reduces the risk of squeezing and/or crushing hands or fingers that are jammed or wedged between moving parts of a bed when adjusting the bed into desired positions; facilitate and simplify the manufacture and assembly of an articulated bed; and increase the applicability of motorised frameworks in beds with differing widths by using an adjustable frame to achieve a simpler, faster, more economic, and safer and more reliable use of articulated beds.

These objects are achieved by a bed arrangement having the features set forth in appended claim 1, preferred embodiments being defined in the related subclaims.

By the improved bed arrangement of the invention, several advantages are obtained. The adjustably mounted support frame together with the power assembly may be used in beds with different widths. A simpler manufacture, assembly and maintenance of the bed arrangement is achieved because the power assembly, the support frame and the mattress support may be separately assembled and disassembled in connection therewith, e.g. the mattress support may be separately removed from the support frame so that maintenance of the power assembly is simplified. The difference in size between the mattress support and the support frame eliminates the risk of squeezing or crushing the hands or fingers of a human being during adjustment of the bed arrangement.

By providing an articulated bed with a motorised framework according to preferred embodiments of the invention, the following advantages are obtained. The difference in size between the mattress support and the stationary outer frame eliminates the risk of squeezing/crushing the hands or fingers of a human being during adjustment of the bed. Moreover, the adjustability and structure of the bed also enhance the safety during adjustment of the bed by minimising the risk of injury, because the moving parts of the power assembly are placed at a sufficiently large distance from the inside of the outer frame.

BRIEF DESCRIPTION OF THE DRAWINGS

The present invention will now be described in more detail with reference to the enclosed drawings, in which.

DETAILED DESCRIPTION OF THE INVENTION

Figure 1:
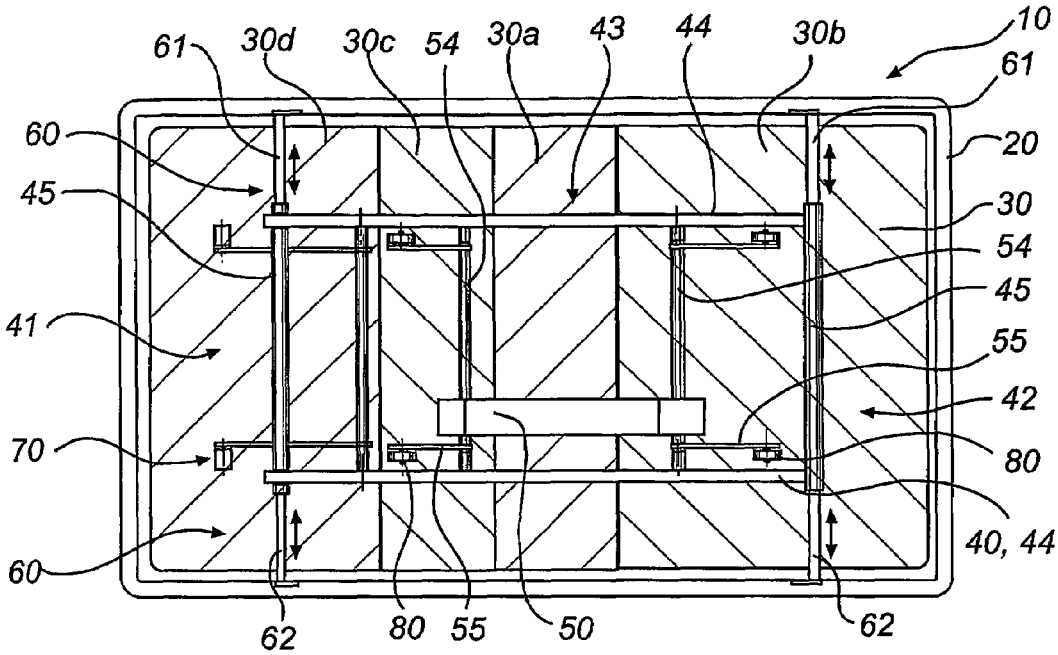
FIG. 1 is a top plan view of an articulated bed according to a first embodiment of the invention.
Figure 2:
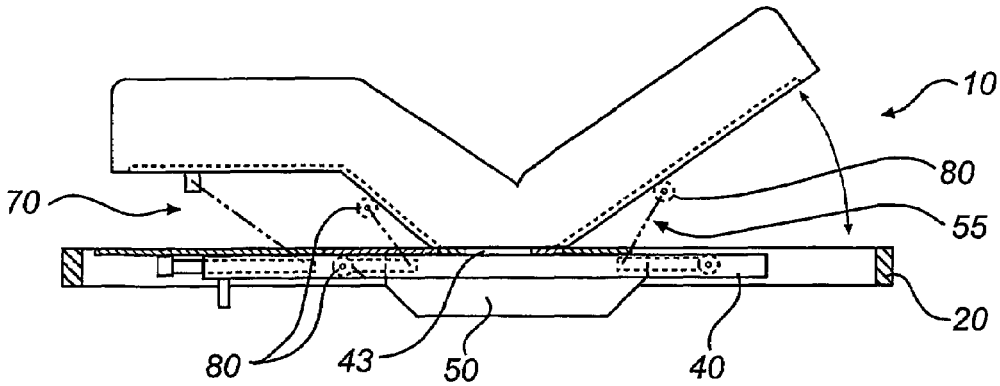
FIG. 2 is a side view of the bed in FIG. 1.
Figure 3:
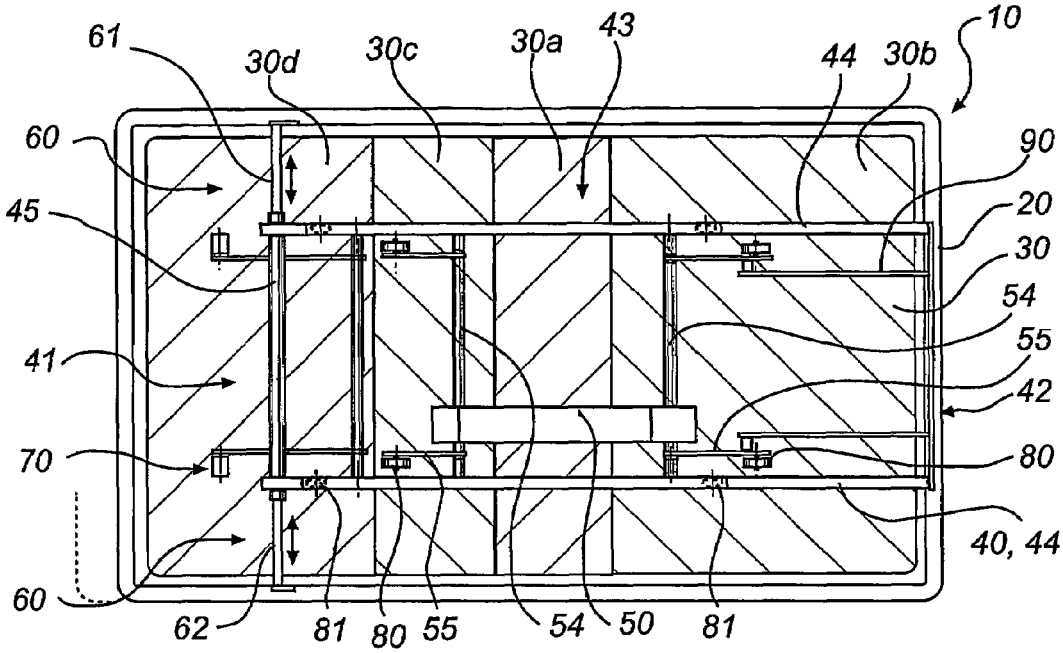
FIG. 3 is a top plan view of the inventive bed according to a second embodiment of the invention.
Figure 4:
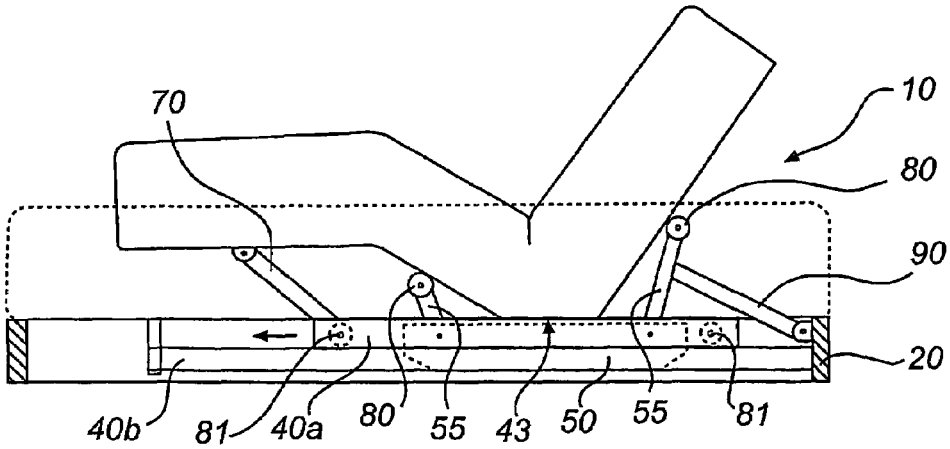
FIG. 4 is a side view of the bed in FIG. 3.
Figure 5:
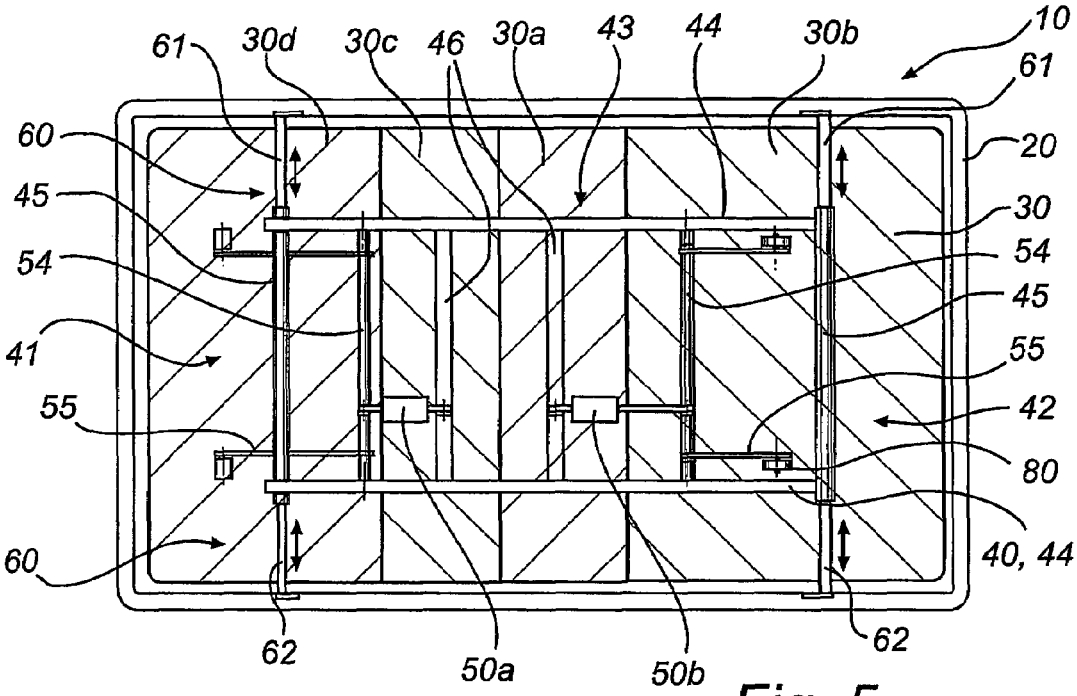
FIG. 5 shows a variant of the the bed and corresponds to FIG. 1.
Figure 6:
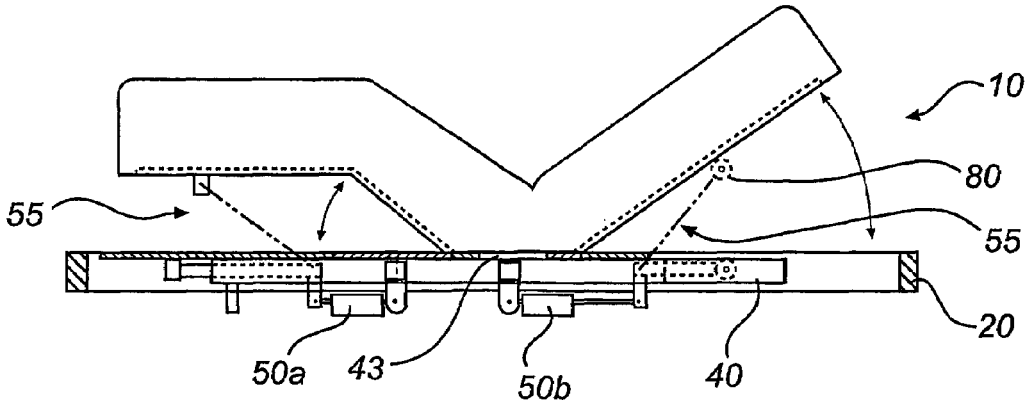
FIG. 6 shows a variant of the the bed and corresponds to FIG. 2.
Figure 7:
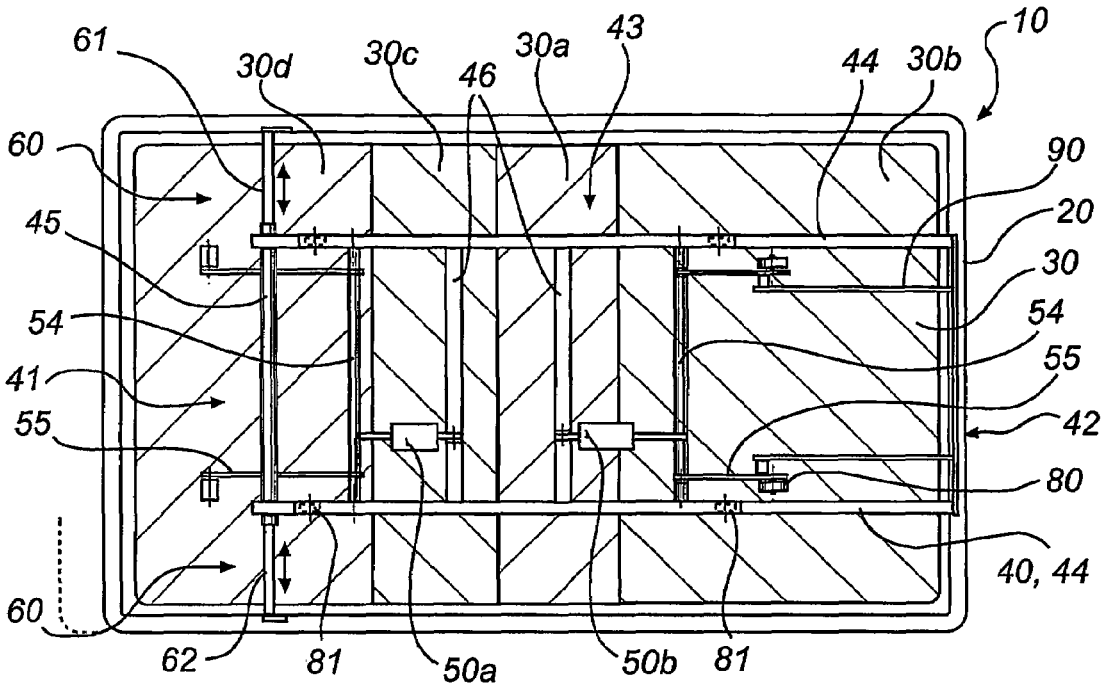
FIG. 7 shows a variant of the the bed and corresponds to FIG. 3.
Figure 8:
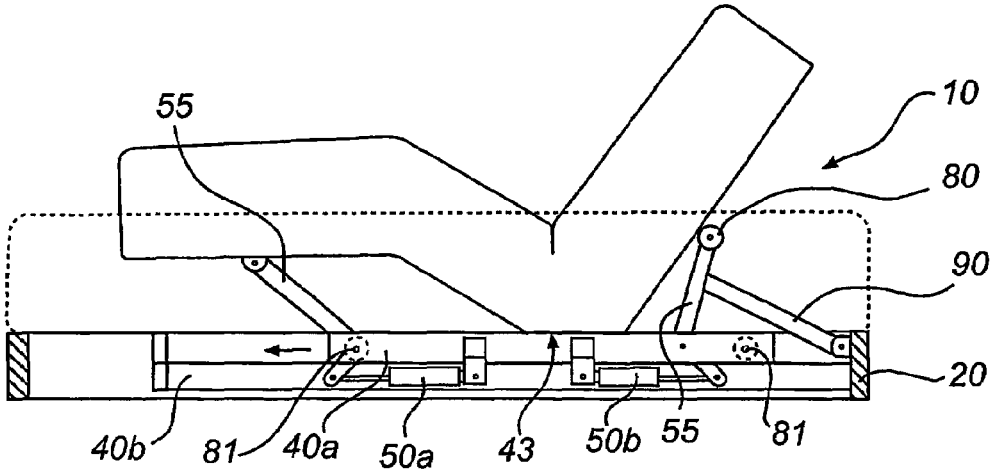
FIG. 8 shows a variant of the the bed and corresponds to FIG. 4.

FIGS. 1 and 2 illustrate a first embodiment of an articulated bed arrangement or bed 10 according to the invention and FIGS. 3 and 4 illustrate a second embodiment of the bed according to the invention.

As shown in FIGS. 1 and 3, the articulated bed 10 according to the invention comprises a substantially square outer fixed or stationary frame 20 and a planar substantially square articulated mattress support 30, which has smaller dimensions than the outer frame 20 to fit inside the same. In FIGS. 1 and 3, the bed according to the invention is shown with the mattress removed. In FIGS. 1 and 3, the flat mattress support is shown partly transparent and with lines similar to cross-sectional lines for clarity reasons.

The size of the articulated mattress support 30 shown in FIGS. 1-4 is adapted for fitting inside the stationary outer frame 20 with its outer circumferential edge 31 facing the fixed outer frame 20 at a distance from the inside of the outer frame 20 of at least 25 mm or more preferred at least 30 mm, preferably between 50-300 mm but most preferably between 60-200 mm when mounted in the bed 10 in both embodiments. It is preferred that the distance between the outer edge 31 of the mattress support 30 and the outer frame 20 is larger than the thickness of a human finger for reducing the risk of squeezing or crushing a finger when inclining the bed into desired positions.

The mattress shown in FIGS. 2 and 4 has a thick bed tick or ticking that extends over and covers the space between the outer frame 20 and the mattress support 30 on all sides of the mattress as seen from above, thereby further reducing the risk of injuring a human being.

The articulated mattress support 30 forms part of a unit comprising three main parts: the transparently shown mattress support 30 with the mattress (shown in FIGS. 2 and 4), an adjustable frame 40 for supporting/carrying the mattress support, a power assembly 50 for motorised, i.e. automatic, adjustment of the bed 10. The power assembly 50 is attached/mounted to the support frame 40 and used to raise or lower the bed 10. The mattress support 30 is articulated by being divided into four sections hinged together, a stationary middle section 30*a*, a swingable head section 30*b*, a swingable thigh section 30*c*, and a swingable foot section 30*d*, as is readily understood by a skilled person and as shown in FIGS. 1 and 3.

The adjustable support frame 40 has one end 41 to the left adjacent the foot end of the bed 10 and one end 42 to the right adjacent the head end of the bed in FIGS. 1-4. The power assembly 50 has two drive or rotor shafts 54 and four drive or rotor arms 55, each rotor shaft 54 having two fixedly attached rotor arms 55, one arm 55 at each end of the associated rotor shaft 54 adjacent the support frame 40. The rotor shafts 54 are rotatably attached to the support frame 40 with one rotor shaft 54 adjacent its end 41 and the other rotor shaft 54 adjacent its end 42. The rotor shafts 54 are driven by a drive motor (not shown).

The support frame 40 in the first embodiment shown in FIGS. 1 and 2 has two elongated and parallel beams 44. extending in the longitudinal direction of the bed 10 and is held together by two shorter beams 45 attached to the ends of the longer beams 44 and extending perpendicularly in relation thereto. The shorter beams 45 are hollow with inner through holes, and each of the shorter beams 45 contains two extensible devices 60 protruding through the shorter beams 45 at each end 41 and 42 of the support frame 40. The shorter beams 45 are similar to sleeves surrounding inner slidable elements. The beams 44, 45 that form the support frame 40 have hollow square cross-sections.

The support frame 40 has a smaller size or smaller dimensions as compared with the mattress support 30 in its planar state or position. The mattress support 30 is detachably attached with its stationary middle section 30*a* at a middle section 43 of the adjustable support frame 40.

A pivotal linkage arrangement 70 common to both embodiments is illustrated to the left in FIGS. 1-4. This left pivotal linkage arrangement 70 adjacent the foot end of the bed 10 comprises a shaft which is rotatably connected at each end to the support frame 40 and two flat bars, each flat bar being pivotally connected at one end to the underside of the mattress support 30 and pivotally connected at the other end to the rotatable shaft. This pivotal foot end linkage arrangement 70 is adapted to passively follow the movement of the foot end 30*c*, 30*d* of the bed 10 when adjusting and/or inclining the mattress support 30 and supports the mattress from below, so that parts of the foot end are kept in an essentially horizontal orientation creating a comfortable foot and leg posture or position for the user of the bed.

The support and orientation of the bed 10 may of course be achieved by using beams having, for example, the following cross-sectional shapes: square, circular, L-, T-, or H-shapes, or even triangular shapes instead of flat bars in the linkage arrangement 70 or hollow square shapes similar to the beams 44, 45 of the support frame 40.

The support frame 40 according to the first embodiment of the invention shown in FIGS. 1 and 2 is adjustable in the lateral direction of the bed 10 by means of two extensible devices 60, a first extensible device 60 to the left and a second extensible device 60 to the right. Each extensible device 60 comprises a pair of extendable parts, an upper part 61 and a lower part 62, as shown in FIGS. 1 and 3. These parts or means 61, 62 are telescopically extendable and can be extended or extracted and retracted lengthwise, i.e. in their longitudinal direction corresponding to the lateral direction of the bed, whereby the support frame 40 can be used in beds with differing widths by adapting or adjusting the length of the extensible devices 60 to the actual width between the inner sides of the outer frame 20.

In the second embodiment of the bed 10 shown in FIGS. 3 and 4, the support frame 40 comprises one framepart or bedplate 40*a* which is displaceable in the longitudinal direction of the bed and one stationary framepart or bedplate 40*b*. The power assembly 50 is mounted onto the movable framepart 40*a* adapted to move relatively to the stationary framepart 40*b* and follows the movable framepart 40*a* when it moves as a slide on top of the stationary framepart 40*b*.

The displaceable framepart 40*a* is movably connected to the outer frame 20 at one end 42 by means of a pivotal linkage arrangement or arm 90 at the head end of the bed 10, as shown in FIGS. 3 and 4. This pivotal head end linkage arrangement 90 is pivotally connected at one end to the outer frame 20 and pivotally connected at the other end to its associated rotor arm 55 of the power assembly 50 at a position between the ends of its associated rotor arm 55 in such a manner that the head end will be respectively raised and lowered in response to commensurate displacement of the movable framepart 40*a* in relation to the outer frame 20. The distance from the head end to the adjacent short end of the bed will therefore remain substantially constant. The stationary framepart 40*b* is adjustable mounted at one end 41 to the fixed outer frame by means of only one extensible device 60, compared with the first embodiment, to the left adjacent the foot end of the bed, and detachably attached at the other end 42 to the inside of the outer fixed frame 20 adjacent the head end of the bed. The stationary framepart 40*b* may of course be adjustably mounted by means of extensible devices 60 at both ends 41 and 42 similarly to the first embodiment, as is envisaged by the skilled person.

The slidable framepart 40*a* moves on top of the stationary framepart 40*b* by means of wheels or rollers 81 rolling on the upper surface of the stationary framepart 40*b* in this embodiment when inclining the bed 10 and is guided in the lateral direction of the bed 10 by guiding means in the form of plates (not shown) attached to the outside of the movable 40*a* or the stationary framepart 40*b* and extending downwards or upwards past the space between the lower surface of the movable framepart 40*a* and the upper surface of the stationary framepart 40*b*.

Alternatively, the movable framepart 40*a* can move inside the stationary framepart 40*b* if the stationary framepart is made of vertically or horizontally oriented beams with U-shaped cross-section, the legs of the U:s facing each other inwards. The movable framepart 40*a* formed by, for example, beams having a square cross-section and the wheels 81 thereof are then fitted into the U-beam forming a rolling surface on the inside. The shape, dimensions, and tolerances of the beam forming the stationary framepart 40*b* and the beam forming the movable framepart 40*a* may of course be adapted in relation to each other, so that the risk of hurting a human being during adjustment of the bed is minimized, as is readily understood by a skilled person.

The wheels/rollers 81 on the movable framepart 40*a* in the embodiment shown in FIGS. 3 and 4 are mounted substantially flush with the underside of the movable framepart 40*a*; so that the distance and open space between the movable 40*a* and stationary framepart 40*b* is minimized, thereby reducing the risk of squeezing or crushing fingers by getting them jammed between these frameparts 40*a*, 40*b* during movement of the movable framepart 40*a*.

The adjustable support frame 40 may be used in beds 10 with widths other than the standard bed widths, since the extensible devices 60 are continuously variable into desired lengths corresponding to the current width of each bed. The support frame 40 may also be adjusted in steps by providing the extensible devices 60 with engaging grooves and ribs placed at predetermined distances along the extensible devices 60. These distances may correspond to different bed widths, e.g. 80, 90, 105, and 120 cm, so that the extensible devices 60 are extended or retracted into desired lengths corresponding to the associated bed width and locked in these positions before assembling the support frame 40. The extensible devices 60 may be locked in their axial or longitudinal directions and positions before assembling the support frame 40 in the bed by means of screws or clamping means common on the market.

The laterally adjustable support frame 40 of both embodiments is detachably attached to the inside of the outer frame 20 by fastening means. Preferably, the extensible devices 60 of the support frame 40 are attached to the outer frame 20 by screws. Alternatively, the fastening means are in the form of wedging or clamping means, i.e. the protruding parts 61 and 62 of the extendable devices 60 have endplates which are placed in or between brackets (not shown) on the inside of the outer frame 20 after assembly, the brackets having corresponding shapes and tolerances in relation to each end of the parts 61 and 62, so that the devices 60 are attached to the outer frame 20 with a wedging effect or only supported in the vertical direction and held in place by the brackets. The extensible devices 60 may also be attached by means adapted to provide a snap connection.

The power assembly 50 shown in FIGS. 1-4 actually forms a housing for enclosing a electrical drive motor (not shown), a number of links, pivots, pivot shafts and the rotor shafts 54 and arms 55 driven by the electrical drive motor. The two rocker shafts 54 extend in the lateral direction of the bed 10. Each rocker arm 55 has a free end with a rotatable wheel/roller 80 engaging the mattress support 30 for swinging the head and foot ends of the bed into desired positions. The electrical drive motor rotates the rocker shafts 54 and each rocker shaft 54 drives two rocker arms 55. The rocker arms 55 engage and raise and lower the respective flexible sections 30*b*, 30*c*, 30*d* of the mattress support 30, i.e. the head end and the foot end of the bed 10.

The support frame 40 and the power assembly 50 with all its associated moving parts, i.e. the rocker shafts 54, the rocker arms 55, the wheels 80 on the free ends of the rocker arms 55, the wheels 81 on the support frame, and the foot and head end pivotal linkage arrangements 70 and 90, are placed at a distance from the inside of the outer frame 20 when mounted in the same. The distance is at least 100 mm, or more preferred 150 mm, preferably between 100-500 mm but most preferably between 150-400 mm. Considering that great forces are at work between the underside of the mattress support 30 and the rolling surface of each wheel or roller 80 when inclining the bed 10, it is preferred that the minimum distance between the wheels 80 of the power assembly 50 and the inside of the outer frame 20 in the circumferential/peripheral direction is greater than the length of a human hand for reducing the risk of squeezing or even crushing hands or fingers.

In FIGS. 5-8 a variant of the inventive bed is shown wherein the power assembly 50 consists of two power assemblies 50*a* and 50*b*. The power assemblies have attachments points on drive shafts 54 and power assembly attachments 46. This variant applies to both of the above described embodiments.

The invention claimed is:

1. A bed arrangement comprising an articulated mattress support, a support frame for the articulated mattress support, and a power assembly for raising and lowering flexible sections of the articulated mattress support, wherein the support frame is adjustably mounted in a stationary outer frame, that the support frame has smaller dimensions than the mattress support, and that the power assembly is mounted on the support frame.

2. A bed arrangement according to claim 1, wherein the support frame is mounted on the stationary outer frame by means of at least one means which is adjustable to the width of the outer frame.

3. A bed arrangement according to claim 1, wherein the articulated mattress support is placed inside the outer frame and its outer circumferential edge is located at a distance from the inside of the outer frame that is greater than the thickness of a human finger, preferably at least 25 mm or more preferred at least 30 mm.

4. A bed arrangement according to claim 1, wherein the support frame together with the power assembly are mounted on the inside of the outer frame and have moving parts for engaging and raising and lowering the mattress support, which moving parts being arranged at a distance from the inside of the outer frame that is greater than the length of a human hand, preferably at least 100 mm or more preferred at least 150 mm.

5. A bed arrangement according to any one of claim 1, wherein both ends of the support frame are attached to the outer frame by the intermediary of the means that are adjustable to the width of the outer frame.

6. A bed arrangement according to any one of claim 1, wherein one end of the support frame is attached to one end of the outer frame and in which the other end of the support frame is attached by the intermediary of the means that are adjustable to the width of the outer frame to the sides of the outer frame at a distance from the other end of the outer frame.

7. A bed arrangement according to any one of claim 1, wherein the support frame has a stationary bedplate and a movable bedplate being longitudinally displaceable in relation thereto, and wherein the power assembly and drive arms and links thereto belonging for raising and lowering the flexible sections of the articulated mattress support are mounted on the movable bedplate.

8. A bed arrangement according to claim 7, wherein at least one drive arm provided at the head end of the bed arrangement for raising and lowering the head support section of the mattress support is connected to the outer frame by means of a pivotable linkage arm whose one end is pivotally attached to the outer frame and whose other end is pivotally attached to the drive arm at a position between the ends of the drive arm.

* * * * *